US005943300A

United States Patent [19]

Johnson

[11] Patent Number: 5,943,300

[45] Date of Patent: Aug. 24, 1999

[54] TIMEPIECE HAVING DISKS OF GRADUATED DESIGN DENSITY

[76] Inventor: Peter R. Johnson, 32219 SW. Boones Bend Rd., Wilsonville, Oreg. 97070

[21] Appl. No.: 08/984,218

[22] Filed: Dec. 3, 1997

Related U.S. Application Data

[63] Continuation of application No. 08/762,743, Dec. 10, 1996, Pat. No. 5,751,663, which is a continuation of application No. 08/685,206, Jul. 23, 1996.

[51] Int. Cl.[6] ..... G04B 19/20; G04B 19/06

[52] U.S. Cl. ..... 368/77; 368/233

[58] Field of Search ..... 368/76, 77, 80, 368/223, 228, 234, 233

[56] References Cited

U.S. PATENT DOCUMENTS

| | | | |
|---|---|---|---|
| D. 218,945 | 10/1970 | Worthington | 42/7 |
| D. 282,914 | 3/1986 | Maron | 10/39 |
| D. 286,755 | 11/1986 | Manfredi | 10/39 |
| D. 291,871 | 9/1987 | Harvey | 10/126 |
| D. 330,341 | 10/1992 | Robert | 10/126 |
| D. 363,251 | 10/1995 | Gardner | 10/126 |
| 2,723,527 | 11/1955 | Smith | 368/233 |
| 2,785,530 | 3/1957 | Mayer | 368/233 |
| 3,439,492 | 4/1969 | Gravenson | 368/233 |
| 3,463,118 | 8/1969 | Wood | 116/129 |
| 3,554,157 | 1/1971 | Haughtington | 116/129 |
| 3,803,831 | 4/1974 | Horzick | 58/126 |
| 4,006,588 | 2/1977 | McMahon et al. | 368/71 |
| 4,206,592 | 6/1980 | Maue | 368/77 |
| 4,692,032 | 9/1987 | Rubin | 368/76 |
| 4,945,522 | 7/1990 | Radel | 368/77 |
| 5,088,440 | 2/1992 | Keaney | 116/298 |
| 5,422,864 | 6/1995 | Lorello | 368/223 |

FOREIGN PATENT DOCUMENTS

| | | | |
|---|---|---|---|
| 2241210 | 3/1973 | Germany | 368/233 |

*Primary Examiner*—Vit Miska

*Attorney, Agent, or Firm*—Chernoff, Vilhauer, McClung & Stenzel, LLP

[57] ABSTRACT

A timepiece that uses disks having sharp zones of contrast of visual design density to indicate time intervals when the sharp zone of contrast is aligned with time interval indicator markings or traditional time indicator positions on a non-rotatable frame. The disks of the chronograph are continuously graduated in visual design density from an area of greatest density to an area of least density to form a sharp zone or line of contrast. The disks are located so that when the sharp zone or line of contrast is aligned with the time indicator markings or positions on the frame, thus displaying the time in an accurate fashion that is easily and quickly discernable even for individuals that are poor sighted. In addition, the timepiece presents such a strikingly novel design that it makes an aesthetic statement that is desirable for use by individuals with no sight problems.

24 Claims, 3 Drawing Sheets

TIMEPIECE HAVING DISKS OF GRADUATED DESIGN DENSITY

This application is a continuation of U.S. patent application Ser. No. 08/762,743 filed Dec. 10, 1996, now U.S. Pat. No. 5,751,663, which is a file wrapper continuation of U.S. patent application Ser. No. 08/685,206 filed Jul. 23, 1996.

BACKGROUND OF THE INVENTION

The following invention relates to a timekeeping device and, in particular, to a timepiece having a visual design that allows sight-impaired individuals to read the time accurately from the timepiece.

Analog timepieces have been in use for hundreds of years, but are particularly ill-suited for poor sighted individuals and for normal sighted individuals under circumstances of poor illumination, or where it is desired to tell time with a quick glance. Typically, analog timepieces include a housing divided into segments with time intervals designated around the periphery and synchronized with the rotation of "hands" that point to a specific hour and/or minute. In order to achieve maximum accuracy, the hands of analog timepieces are often slender and difficult to discern by poorly sighted individuals or by normal sighted individuals under poor lighting conditions. Thus, poor sighted individuals have difficulty reading traditional analog timepieces because of the narrowness of the time indicators or hands even when studying the device for a long period of time. The same is true of normal sighted individuals under poorly lighted conditions. The traditional analog timepieces are therefore completely ineffective for allowing poor sighted individuals to quickly and accurately determine the time, and for allowing normal sighted individuals to tell the time quickly and accurately under poorly lighted conditions.

Digital timepieces, especially wristwatches, likewise do not allow poor sighted individuals to accurately tell the time quickly, accurately or easily. The numbers displayed on digital wristwatches are small and may be difficult to read, even for those without sight problems. In addition, some of the numbers displayed in a typical digital timepiece are easily confused. For example, the numbers 3, 5 and 8 can be similar in appearance in a typical digital display. A poor sighted individual could easily mistake one of those numbers for another with a quick glance, and often cannot precisely determine differences in numerals even with a prolonged look at the face of the timepiece.

While timepieces that utilize color and/or design variation are well known in the industry, there is no product that provides a reliable indicator of time for sight-impaired persons. Lorello, U.S. Pat. No. 5,422,864 uses color to indicate precise minutes, either before or after the hour. Radal, U.S. Pat. No. 4,945,522 discloses a timepiece that utilizes color to optically suppress all information not necessary to reading the time, but the color employed in Radal does not relate to time interval identification at all. Maue, U.S. Pat. No. 4,206,592 discloses a timepiece that utilizes color to aid in the identification of time intervals. McMahon, U.S. Pat. No. 4,006,588 discloses a watch face that identifies the hour by an aperture which displays a different color for each time interval, and requires the user to learn or memorize the various different colors for each interval.

Horzick, U.S. Pat. No. 3,803,831 discloses overlaid translucent rotary dial disks that indicate time increments by a continually expanding zone of either light or darker color. The boundaries of the regions of darker or lighter colors are ambiguous, however, and it is difficult to tell the time accurately.

SUMMARY OF THE INVENTION

The present invention is a timepiece that depicts time intervals in such a way that it allows even poorly sighted individuals to quickly and accurately read the time. The invention uses disks having annular bands or rings of graduated visual design density to form a sharp contrast zone between the area of greatest visual design density and the area of least visual design density at the juncture of the two regions. The term "visual design density" as used herein represents a design intensity that may include coloration, lines, dots or other design artifacts. In general, areas of greatest design density are "darker" or more heavily shaded than areas of lesser design density. Time intervals are identified when the sharp contrast zone is aligned with a time indicator position such as the time indicator positions of a traditional analog timepiece (i.e., straight up is 12 o'clock, 3 o'clock is 9:00 moving clockwise from 12 o'clock, straight down is 6 o'clock). The eye follows the graduated visual design density to the point of the greatest contrast which is easily readable by individuals having poor eyesight or by normal sighted individuals under poorly lighted conditions. Thus, the timepiece of this invention indicates time intervals in the same manner as a traditional analog timepiece, only using visual design density contrast zones to indicate time instead of the traditional "hands" of an analog timepiece.

The invention employs a myriad of unique and aesthetically appealing visual designs generally arranged in rings or annular bands that are graduated from an area of greatest visual design density to an area of least visual design density to create a sharp zone of contrast at the juncture of the two regions. This zone is synchronized with time indicators to indicate time intervals and thereby overcomes the difficulties of previous methods of time indication-for poor sighted individuals.

The present invention may have separate disks for each time interval indicator, i.e., separate disks for hours, minutes, seconds. Each disk has its own graduation of visual design density and/or coloration, and each may be different from the other. Each disk, however, provides a sharp zone of contrast on each respective band and for each time interval indication desired. The direction of preparation of the variable design density can be the same for each disk or may be different for one or more disks. The disks may be nested and the innermost disk may provide a cavity for the placement of a design artifact such as a jewel or insignia. Alternatively, the disks' interiority of the band may be transparent to show the inner workings of the timepiece.

The timepiece of the invention can also be adapted to display a "clock" on a computer screen or modified to serve as a constantly changing "screen saver," occupying the entire computer screen.

Accordingly, it is an object of the present invention to provide a timepiece that allows poor sighted individuals to quickly and accurately read the time. Another object of the present invention is to provide a timepiece that allows normal sighted individuals to quickly and accurately read the time even under poorly lighted conditions.

It is an advantage of the present invention that a timepiece is provided that is of such strikingly novel design and functionality that it makes a novel aesthetic statement, and is therefore desirable to be used by individuals with no sight problems.

Yet another advantage is to provide a timepiece which is of simple reliable and rugged construction, yet economical to manufacture and maintain.

Yet another advantage is to provide a timepiece that can be incorporated into other products such as computer screen clocks and screen savers.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
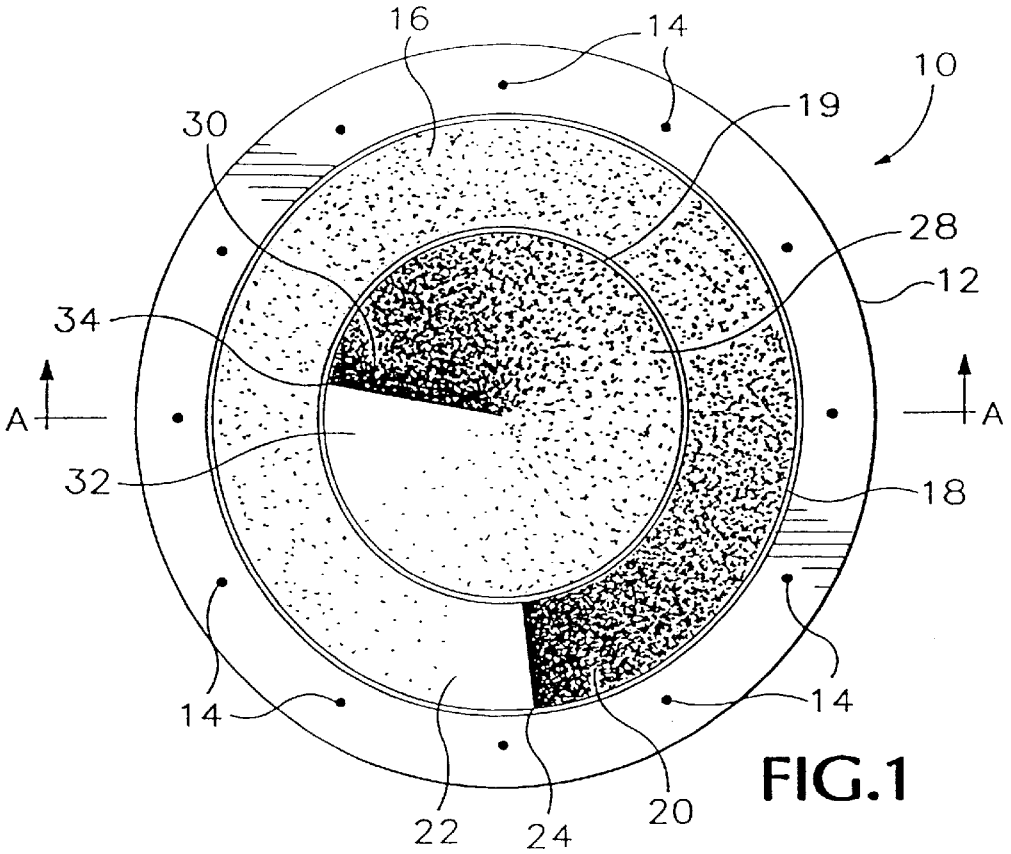
FIG. 1 is a top view of a timepiece employing the invention.

A timepiece 10 such as a wrist watch includes a frame 12 having time indicator markings 14 spaced about the periphery of the frame 12 in conventional hour positions as might be found on a typical analog timepiece. In the embodiment of FIG. 1 the markings 14 indicate twelve hours such as 12:00, 1:00, 2:00, etc. However, there could be any number of such indicator markings and some traditional analog time pieces provide only four of such markings at the 12:00, 3:00, 6:00 and 9:00 positions. In addition, the markings could be arabic or roman numerals, dots, slashes, jewels, artifacts or any other kind of marking.

A first rotatable disk 16 includes a visual design in an annular band or ring 18. The design about the circumference of the band 18 has a visual design density that proceeds from a region of highest design density 20 to a region of lowest design density 22 so as to form a time-invariant sharp contrast zone 24 at the juncture of the design density regions 20 and 22. The rotation of the disk 16 is synchronized such that the sharp contrast zone 24 periodically aligns with the time indicator markings 14 to indicate a component of time (i.e. hours, minutes or seconds). Because the variable design density is spread over the entire radial width of the band or ring 18, a sight impaired person can easily discern the location of the sharp contrast zone and thereby be able to perceive its location relative to the time indicator markings 14.

A second rotatable disk 28 located radially inwardly of the first rotatable disk 16 also includes a band 19 (which in this case occupies substantially the entire disk) with a design having a variable design density and includes a first region of most dense visual design density 30 that is continuously graduated in a clockwise direction to a region of least design density 32 thereby forming a second sharp contrast zone 34 at the juncture between the two regions 30 and 32. The variable design density in the bands 16 and 19 is shown in FIG. 1 as a collection of dots or speckles but could be any visual design including variations in color intensity. If color is used, the area of greatest design density will be perceived as a "dark" region or region of most intense color and the region of least design density will be perceived visually as a "light" region or one of lightest coloration.

Figure 3:
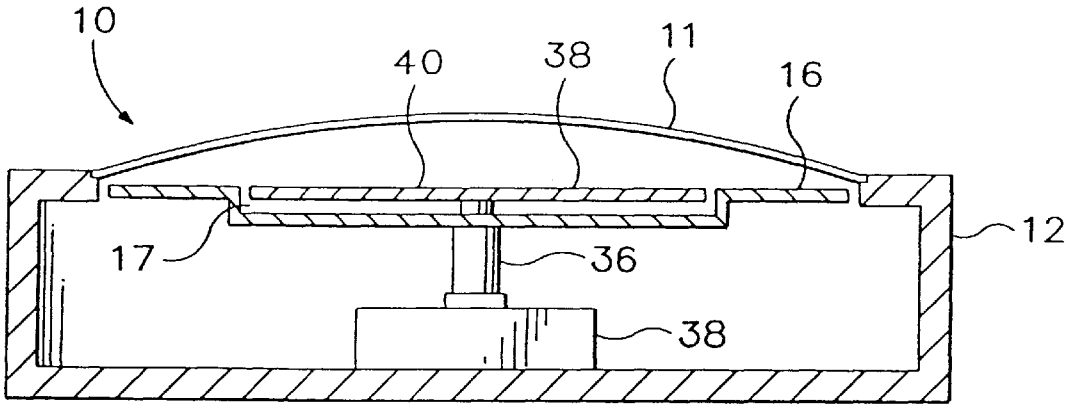
FIG. 3 is a side cutaway view taken along line A—A of FIG. 1.

Referring to FIG. 3, the rotatable disk 16 is included within the frame 12 covered by a watch crystal 11 which may be constructed along the lines of a conventional wrist watch. The disk 16 is supported on a central post 36 which is driven by a drive machine 38. The disk 28 is supported by a post 40 which is concentric to the post 36. Conventionally, disk 16 would be driven by the drive machine 38 so that it would make a complete rotation once every hour by appropriate gearing in the drive machine 38 (not shown). Synchronization may be accomplished in the conventional way by rotatably adjusting the disk 16. The disk 28 could be driven by post 40 so that it makes one complete revolution every twelve hours so as to indicate hours in the conventional manner. In order to provide a pleasing and aesthetic visual impression, the disk 28 may be nested within a recess 17 in disk 16 so as to form a substantially planar surface appearance when viewed by the user. Preferably the bands 18 and 19 should be opaque if the disks are to be nested so that there is no confusion regarding the relative positions of the sharp contrast zones 34 and 24. This provides for sharp contrast zones 34 and 24 that are time-invariant and that provide an indication of time having a time- and position-invariant degree of sharpness and clarity.

Figure 2:
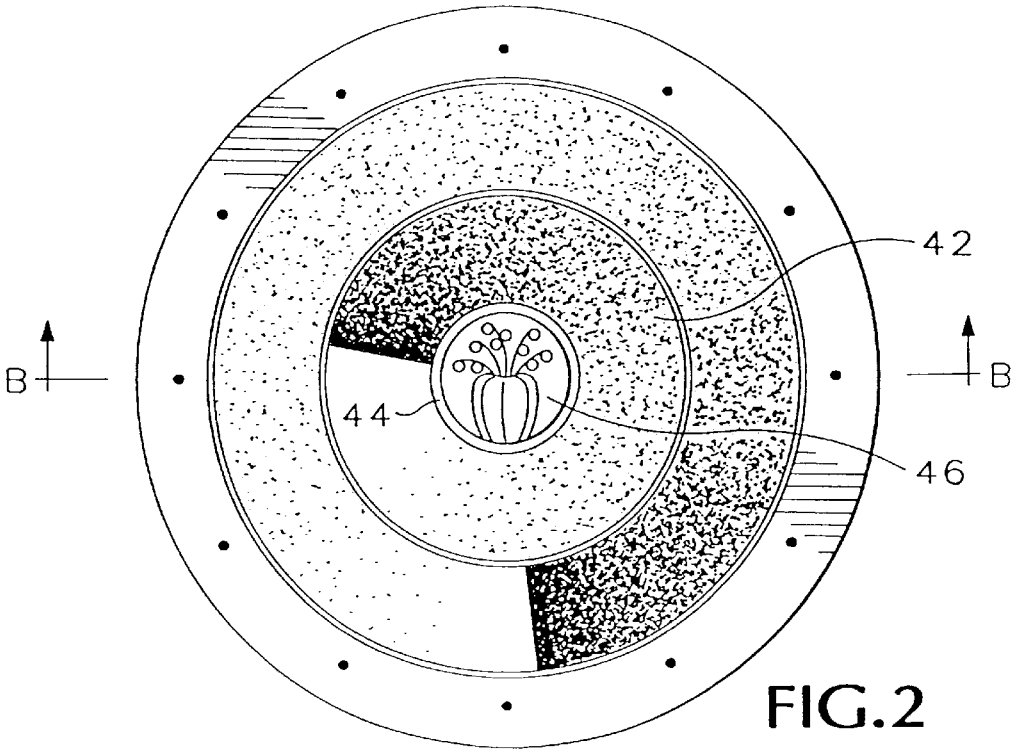
FIG. 2 is a top view of an alternative embodiment of a timepiece employing the invention.

The embodiment of FIG. 2 is in all respects similar to the embodiment of FIG. 1 with the exception that the inner rotatable disk 42 includes a recess or cavity 44 into which a decorative artifact 46 may be placed. The decorative artifact 46 could be a jewel or an insignia or an emblem and could either remain fixed or could rotate with disk 42. As shown in FIG. 2 the recess 44 is an integral part of the disk 42 so that the artifact 46 rotates with disk 42. Alternatively the artifact 46 could be supported on a stationary inner post (not shown) through an aperture in the center of disk 42 so that it remained stationary at all times.

Figure 4:
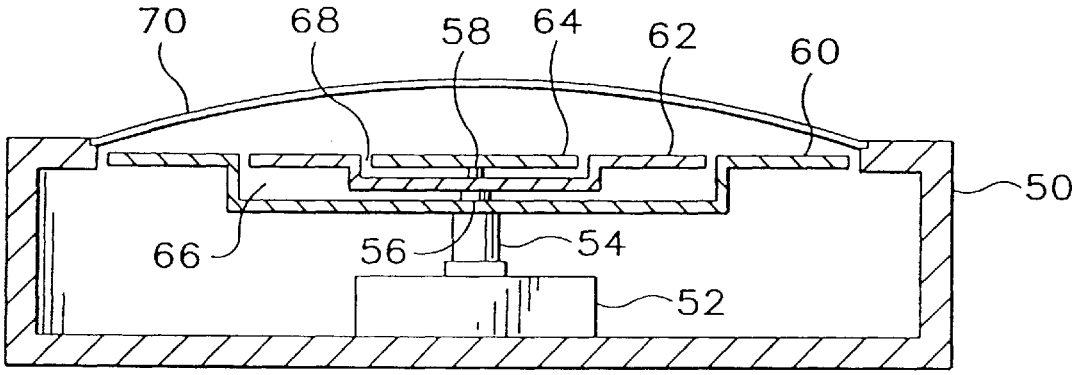
FIG. 4 is a side cutaway view of an alternative embodiment of the invention employing a seconds indicator.
Figure 5:
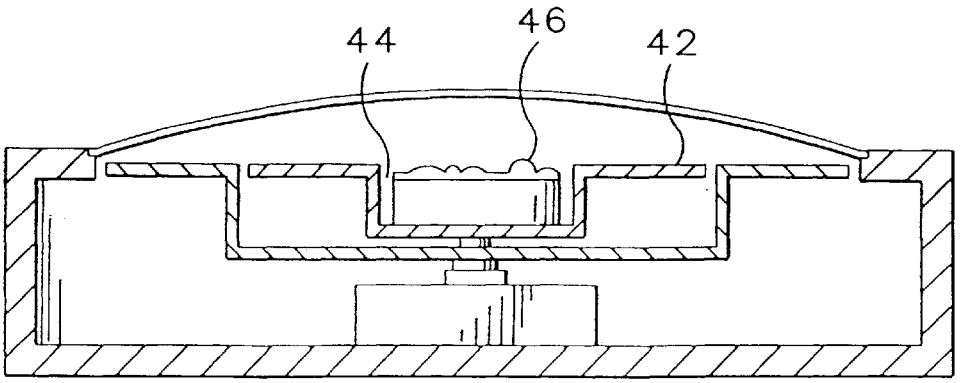
FIG. 5 is a side cutaway view of a timepiece of FIG. 2 taken along line B—B of FIG. 2.

An embodiment of the invention showing rotatable disks for indicating minutes, hours and seconds is shown in FIG. 4. A frame 50 includes a drive machine 52 having output posts 54, 56 and 58 which rotatably support disks 60, 62 and 64, respectively. It should be understood that the disks 60, 62, and 64 include annular bands or rings similar to those shown in FIGS. 1 and 2 employing a design having a variable design density which proceeds around the circumferences of each band over substantially the entire width of each to create a sharp contrast zone between regions of highest visual design density and regions of lowest visual design density. The disks 60, 62 and 64 are geared in the drive machine 52 to indicate hours, minutes and seconds. It is not critical to the invention as to which disk is chosen to represent which time indication, as this may be a matter of aesthetic or design choice. The disks 60, 62 and 64 are nested as provided in recesses 66 and 68 so as to present to the viewer a substantially planar surface. The mechanism including the disks is protected by a conventional watch crystal 70.

Figure 6:
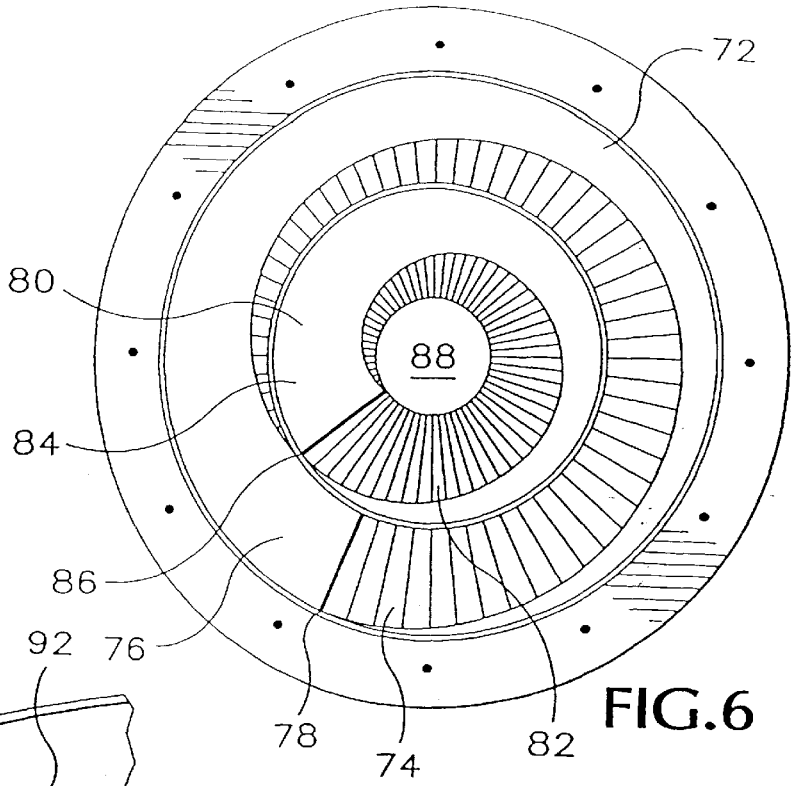
FIG. 6 is a top view of an alternative embodiment of the invention employing a spiral design.

A different aesthetic design is shown in FIG. 6. Mechanically FIG. 6 is similar to the design of FIG. 1 with the exception that the design is shown as a spiral pattern. An outer annular band or ring 72 has a radial line pattern that spans substantially the entire width of the hand 72 to thus create a zone of highest design density 74. The lines grow progressively shorter in a counterclockwise direction around the band 72 to create a visually pleasing spiral pattern narrowing to a vanishing point at a region of least visual design density 76 to thereby create a sharp visual contrast zone 78. Likewise an inner band 80 includes a highest design density region 82 spiraling inwardly to a region of lowest design density 84 thereby creating a second sharp contrast zone 86. In addition, the embodiment of FIG. 6 includes a transparent center region 88 through which one may view an internal design or the internal workings of the watch such as gears, etc. (not shown).

Figure 7:
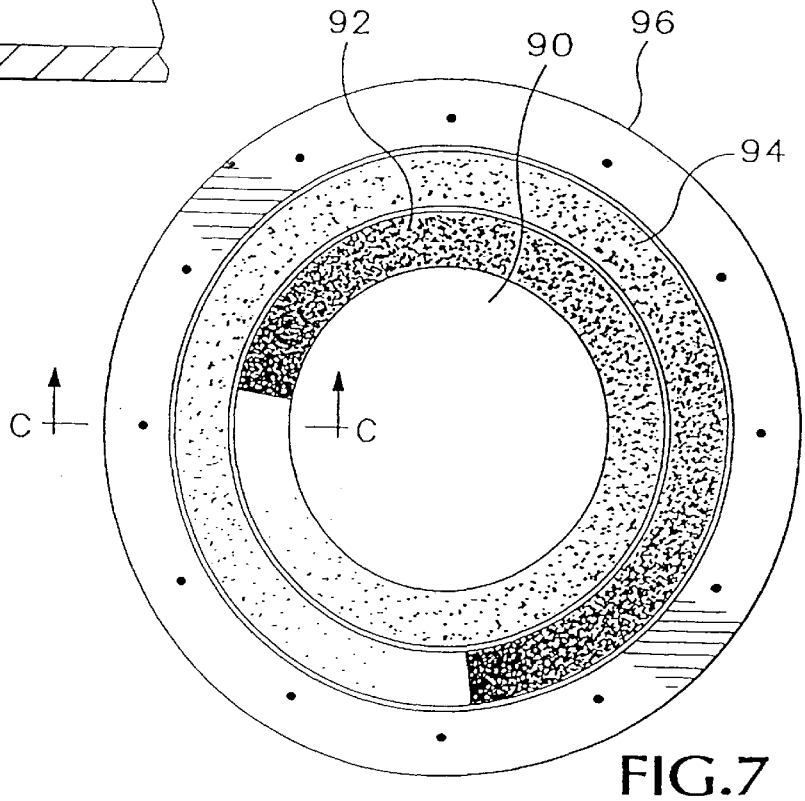
FIG. 7 is a top view of an alternative embodiment of the invention showing a large central cavity.

The embodiment of FIG. 7 is in all respects similar to the embodiment of FIG. 2 with the exception that the interior cavity or recess 90 is not an integral part of the inner rotatable disk 92. In addition, the interior cavity 90 is substantially larger than recess or cavity 44 of FIG. 2. The outer disk 94 and the inner rotatable disk 94 are attached to the sides of the frame 96 by arms, posts or other similar flanges (not shown), allowing for the larger interior cavity 90.

Figure 8:
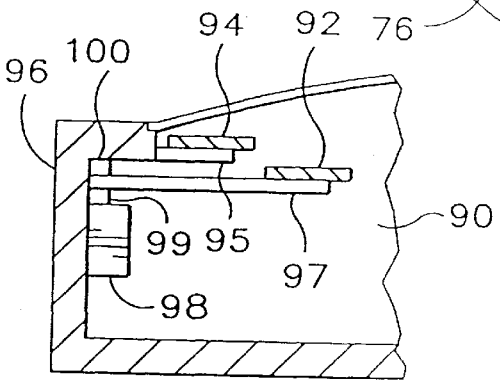
FIG. 8 is a partial side cutaway view taken along line C—C of FIG. 7.

Referring to FIG. 8, the inner rotatable disk 92 is mounted upon an arm 97 which is attached to the side of the frame 96. The outer rotatable disk 92 is mounted upon an arm 97 which is attached to the side of the frame 96. The outer rotatable disk 94 is mounted upon an arm 95 which is attached to the side of the frame 96. A drive machine 98 is mounted to the side of the frame 96 and attached to arms 95 and 97 by post 99 and 100. Appropriate gearing on arms 95 and 97 (not shown) would allow the disks to be rotated and synchronized to indicate appropriate time intervals.

Although the embodiments shown are for use with a wrist watch, the invention is applicable to any timepiece. It may be implemented in software, for example, for a visual display on a computer screen as a clock or as a computer screen saver. Thus, it is to be understood that references to physical objects such as a "frame" apply to virtual representations thereof as well. Thus, the disks of a computer-generated timepiece do not physically rotate, but appear to do so by a-changing graphical representation.

The same concept may be employed in other timepieces wherein the bands or rings may be in the form of small LCD, LED, polarized as in the case of such optical ceramics as lead, lanthanum, zicronate or titanate or electroluminescent screens to which visual information is written giving the appearance of rotation.

For disks that physically rotate in clock or watch casings, any drive machine may be employed since the particular choice of such a machine is not critical to the invention. Thus, in cases where it is desirable to provide a large transparent region in the center of the timepiece such as region 90 in FIG. 7, the disks may be driven from the periphery of the frame by gears or by magnetic means. In addition, the batteries, springs and other timekeeping mechanisms may also be located on the periphery so that a central empty cavity is created into which jewels, insignia, emblems or other artifacts could be placed.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A timepiece comprising a frame having time indicator markings and at least a first rotatable disk rotating about an axis, said first rotatable disk having a first band or ring smoothly continuously graduated in visual design density from a region of a most dense visual design density to a region of least dense visual design density so as to form a first time-invariant sharp contrast zone at a juncture between said regions, said disk being rotatably synchronized to provide an indicator of time having a time- and position-invariant contrast ratio as said first sharp contrast zone aligns with said time indicator markings.

2. The timepiece of claim 1 wherein said first band or ring is opaque.

3. The timepiece of claim 1 further including at least a second rotatable disk concentrically mounted with respect to said first rotatable disk, said second disk having a second band or ring smoothly continuously graduated in visual design density from a first region of a most dense visual design density to a second region of least dense visual design density so as to form a second time-invariant sharp contrast zone at a junction between said regions, said second disk being rotatably synchronized so as to provide an indicator of time having a time- and position-invariant contrast ratio and being different from that provided by said first sharp contrast zone as said second sharp contrast zone aligns with said time indicator markings.

4. The timepiece of claim 3 wherein said second disk includes a transparent region situated radially inwardly of said second band or ring.

5. The timepiece of claim 3 wherein said second disk includes a region for mounting a decorative artifact located radially inwardly of said second band or ring.

6. The timepiece of claim 1 wherein said first band or ring includes a spiral decorative pattern extending from said first region to said second region to form a first sharp contrast zone at a juncture of said regions.

7. The timepiece of claim 6 further including at least a second disk concentrically mounted with respect to said first disk, said second disk having a second band or ring including a spiral decorative design continuously narrowing from said region of most dense visual design density to said region of least dense visual design density so as to form second sharp contrast zone at a juncture between said regions, said second disk being rotatably synchronized so as to provide an indicator of time different from that provided by first sharp contrast zone as said second sharp contrast zone is aligned with said time indicator markings.

8. The timepiece of claim 7 wherein said first disk is rotated in a direction opposite to that of the direction in which said second disk is rotated.

9. The timepiece of claim 1 wherein said first disk is rotated in a direction opposite to that of the direction in which said second disk is rotated.

10. A timepiece comprising:

(a) a non-rotatable frame;

(b) a first rotatable disk rotatable about an axis and disposed within said frame, said disk including a first substantially opaque annular band having a visual design continuously graduated in visual design density from a first region of most dense visual design to a second region of least dense visual design so as to form a time-invariant sharp contrast zone between said first and second regions; and (c) a drive machine coupled to said first rotatable disk and synchronized therewith such that time indications having a time- and position-invariant contrast ratio are provided by an alignment of said sharp contrast zone with positions along said frame indicative of hours or minutes.

11. The timepiece of claim 10, further including a second rotatable disk rotatable about said axis and having a second substantially opaque annular band concentric with said first annular band and continuously graduated in visual design density so as to form a second time-invariant sharp contrast zone between said regions, said second rotatable disk coupled to said drive machine and synchronized therewith to provide an indication of time having a time- and position-invariant contrast ratio different from said first rotatable disk.

12. The timepiece of claim 11 wherein said second rotatable disk includes an at least partially transparent region located radically inwardly of said second substantially opaque annular band.

13. The timepiece of claim 11 wherein said second rotatable disk includes a region for mounting a decorative artifact located radially inwardly of said second substantially opaque annular band.

14. The timepiece of claim 13 wherein said region for mounting a decorative artifact comprises a vertically recessed region along said axis.

15. The timepiece of claim 11 wherein said first rotatable disk is synchronized to indicate minutes and said second rotatable disk is synchronized to represent hours.

16. The timepiece of claim 11 wherein said visual design comprises a substantially solid color.

17. The timepiece of claim 11 wherein said visual design comprises a spiral pattern.

18. The timepiece of claim 17 wherein said spiral pattern spirals radially inwardly from said first region to said second region.

19. The timepiece of claim 18 wherein said spiral pattern spirals radially outwardly from said first region to said second region.

20. A timepiece comprising:

(a) non-rotatable frame with time indicator markings;

(b) at least a first rotatable disk disposed within said frame rotating about an axis, said first disk having a visual coloration substantially continuously smoothly graduated in density from a region of most dense visual coloration to a region of least dense visual coloration to form a first time-invariant sharp contrast zone at a juncture between said regions, said disk being rotatably synchronized so as to provide an indicator of time having a time- and position-invariant contrast ratio as said first sharp zone of contrast assumes positions relative to said time indicator markings on said frame; and (c) a drive machine coupled to said first disk and synchronized therewith for rotating said disk.

21. A timepiece according to claim 20, further including a second rotatable disk, that is continuously smoothly graduated in coloration from a region of most dense coloration to a region of least dense coloration so as to form a second time-invariant sharp zone of contrast having a time-invariant contrast ratio at a juncture between said regions, said first rotatable disk indicating hour intervals and said second rotatable disk indicating minute intervals.

22. A timepiece according to claim 21, further including a third rotatable disk indicating second intervals.

23. A timepiece according to claim 22 wherein said disks form a substantially planar surface, wherein at least one of said disks includes a region located radially inwardly of said disk defining a cavity into which another one of said disks is placed.

24. A timepiece according to claim 23 wherein said disks are nested together in recesses and define a central cavity.

* * * * *